US007878255B2

(12) United States Patent
Howell et al.

(10) Patent No.: US 7,878,255 B2
(45) Date of Patent: Feb. 1, 2011

(54) METHOD OF ACTIVATING A DOWNHOLE TOOL ASSEMBLY

(75) Inventors: Matt Howell, Duncan, OK (US); Kevin Manke, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 12/609,756

(22) Filed: Oct. 30, 2009

(65) Prior Publication Data

US 2010/0044056 A1 Feb. 25, 2010

Related U.S. Application Data

(63) Continuation of application No. 11/678,067, filed on Feb. 23, 2007, now abandoned.

(51) Int. Cl.
*E21B 23/00* (2006.01)

(52) U.S. Cl. ..... 166/381; 166/331; 166/240

(58) Field of Classification Search ..... 166/381, 166/331, 240

See application file for complete search history.

(56) References Cited

U.S. PATENT DOCUMENTS 6,513,589 B1 * 2/2003 Hansen et al. ..... 166/117.5
2006/0260819 A1 * 11/2006 Manke et al. ..... 166/381

OTHER PUBLICATIONS

Office Action in U.S. Appl. No. 11/678,067, Mar. 19, 2009.
Communication from Application No. 08 709 444.7-2316, Mar. 31, 2010.

* cited by examiner

*Primary Examiner*—William P Neuder
*Assistant Examiner*—David Andrews
(74) *Attorney, Agent, or Firm*—John W. Wustenberg; Baker Botts LLP

(57) ABSTRACT

The downhole tool assembly has a sleeve with a continuous j-slot, a lug rotator ring configured to move axially relative to the sleeve and having a lug configured to move within the continuous j-slot, and a rupture disk configured to prevent the lug from moving within the continuous j-slot during run-in. The method includes lowering the downhole tool assembly into a well bore on a tool string, rupturing the rupture disk, allowing the lug to move within the continuous j-slot, and setting the downhole tool assembly by lifting upward and pushing downward on the tool string.

8 Claims, 6 Drawing Sheets

METHOD OF ACTIVATING A DOWNHOLE TOOL ASSEMBLY

CROSS-REFERENCE TO RELATED APPLICATIONS

This application is a continuation of U.S. patent application Ser. No. 11/678,067 filed Feb. 23, 2007 now abandoned, which is hereby incorporated by reference it its entirety.

BACKGROUND

The present invention relates to locking apparatus for downhole tools, and more particularly, to a pressure activated locking slot assembly.

Typically, when tools are run into the well bore, a mandrel is held in the run-in-hole position by interaction of a lug with a J-slot. To move the tool out of the run-in-hole position generally involves the application of torque and longitudinal force. Such an arrangement can be problematic in offshore or highly deviated sections of a well bore, where dragging forces on the tool string may create difficulty in estimating the proper torque to apply at the surface to obtain the desirable torque at the J-slot. A continuous J-slot wraps all the way around the mandrel and typically has two lugs, so that the direction of torque applied need not be reversed in order to actuate. Rather, the tool may simply be picked up and put back down to cycle.

A problem may arise when running such a tool into an offshore or highly deviated well bore. Dragging of the tool string on the well bore may cause the mandrel move relatively upwardly and rotate with respect to the drag block assembly sufficiently to result in premature actuation of the J-slot assembly. If such premature actuation occurs, subsequent downward load on the tool string may rupture the tool elements, or the tool elements may be damaged by dragging along the well bore. In addition, premature actuation may result in the tool string jamming in the well bore.

SUMMARY

The present invention relates to locking apparatus for downhole tools, and more particularly, to a pressure activated locking slot assembly.

In one embodiment of the present invention a locking slot assembly comprises: a slot; a lug configured to move within the slot; and a lock configured to prevent the lug from moving within the slot until a triggering event occurs; wherein the lock is further configured to allow the lug to move within the slot after the triggering event has occurred, so long as a predetermined condition is maintained. The triggering event may be the application of a predetermined pressure, and the predetermined condition may be a minimum pressure.

In another embodiment of the present invention a downhole tool assembly comprises: a sleeve having a slot; a lug rotator ring configured to move axially relative to the sleeve, the rotator ring having a lug configured to move within the slot; and a lock configured to prevent the lug from moving within the slot until a predetermined pressure is applied; and wherein the lock is further configured to allow the lug to move within the slot after the predetermined pressure has been applied, so long as a minimum pressure is maintained.

In yet another embodiment of the present invention a method of activating a downhole tool assembly comprises: providing a downhole tool assembly in a well bore; applying a predetermined pressure to the downhole tool assembly; and moving the downhole tool assembly upward; wherein the downhole tool assembly comprises a sleeve having a slot, a lug rotator ring configured to move axially relative to the sleeve, the rotator ring having a lug configured to move within the slot, and a lock configured to prevent the lug from moving within the slot until a predetermined pressure is applied.

DETAILED DESCRIPTION

Figure 1A:
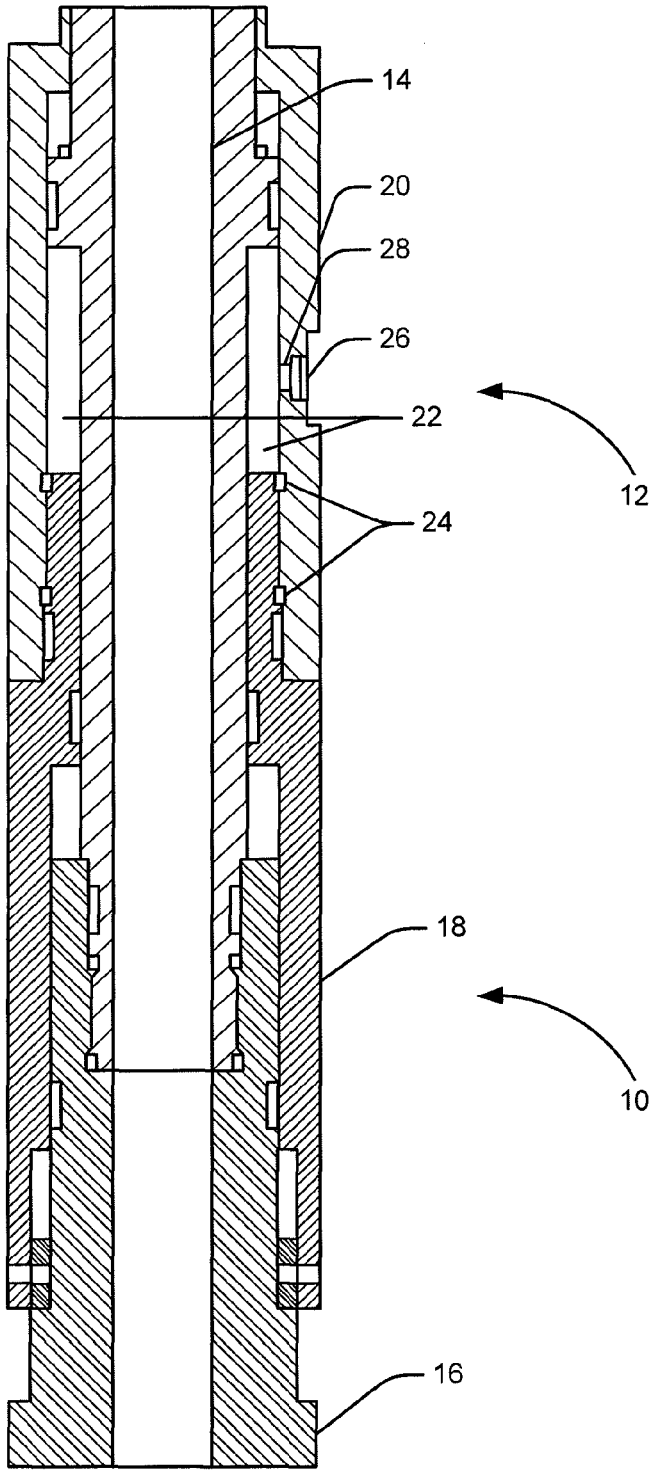
FIG. 1A is a side cross-sectional view showing one embodiment according to the present invention.
Figure 1B:
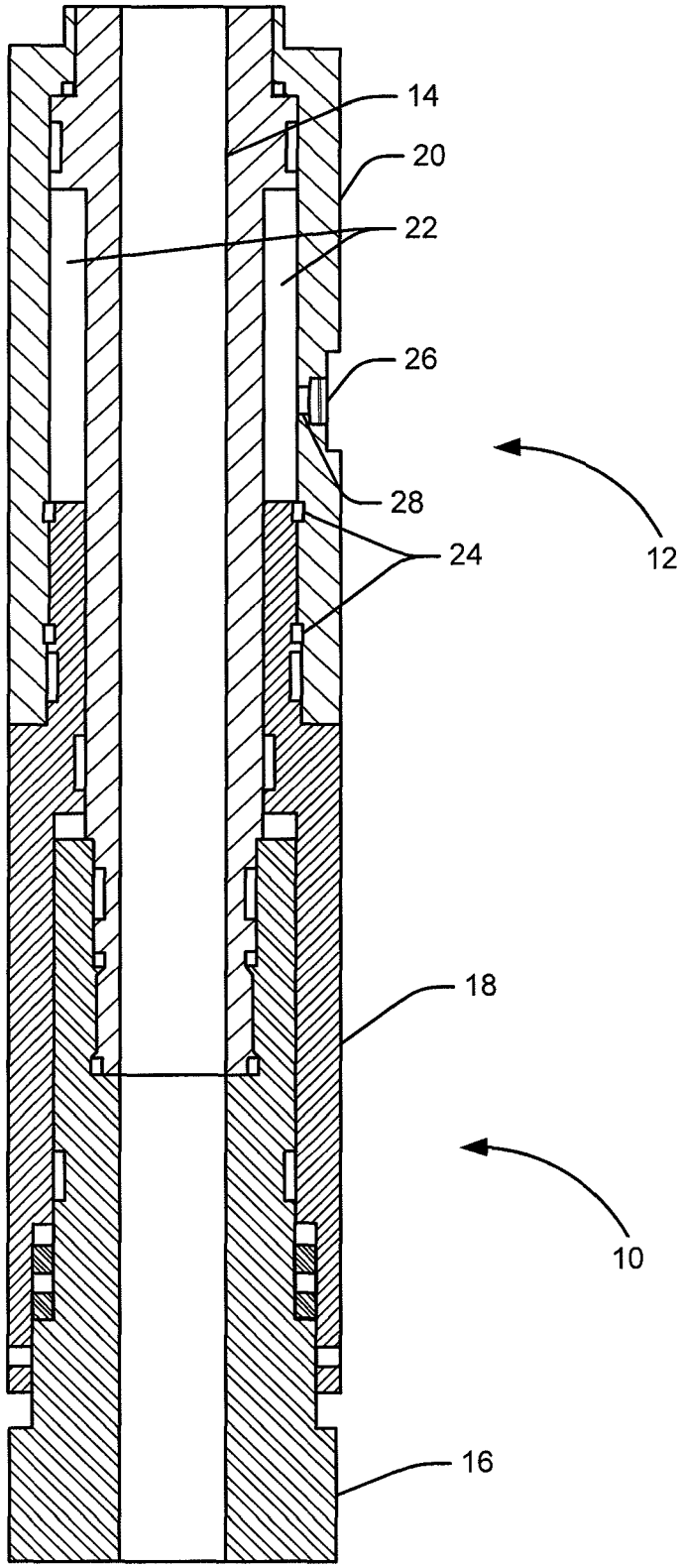
FIG. 1B is a side cross-sectional view of the embodiment illustrated in FIG. 1A, showing an unlocked position.

Referring now to the drawings and more particularly to FIGS. 1A and 1B, the locking slot assembly of the present invention is shown and generally designated by the numeral 10. Locking slot assembly 10 is disposed adjacent to a lower end of a tool 12 (shown in FIG. 2A), which is of a kind known in the art, such as a valve, a packer, or any tool requiring different positions. Tool 12 may connect to a tool string (not shown) and the entire tool string may be positioned in a well bore. The well bore may be defined by a casing (not shown) and may be vertical, or the well bore may be deviated to any degree.

Locking slot assembly 10 is illustrated below the tool 12. Tool 12 may include, or be attached to, an inner, actuating mandrel 14, which may be connected to the tool string. Locking slot assembly may include the actuating mandrel 14, attached at a lower end to bottom adapter 16. Actuating mandrel 14 and at least a portion of bottom adapter 16 may be situated within a fluid chamber case 18 and/or a lock 20. The fluid chamber case 18 and the lock 20 may be removably attached, fixedly attached, or even integrally formed with one another. Alternatively fluid chamber case 18 and lock 20 may be separate.

Figure 3A:
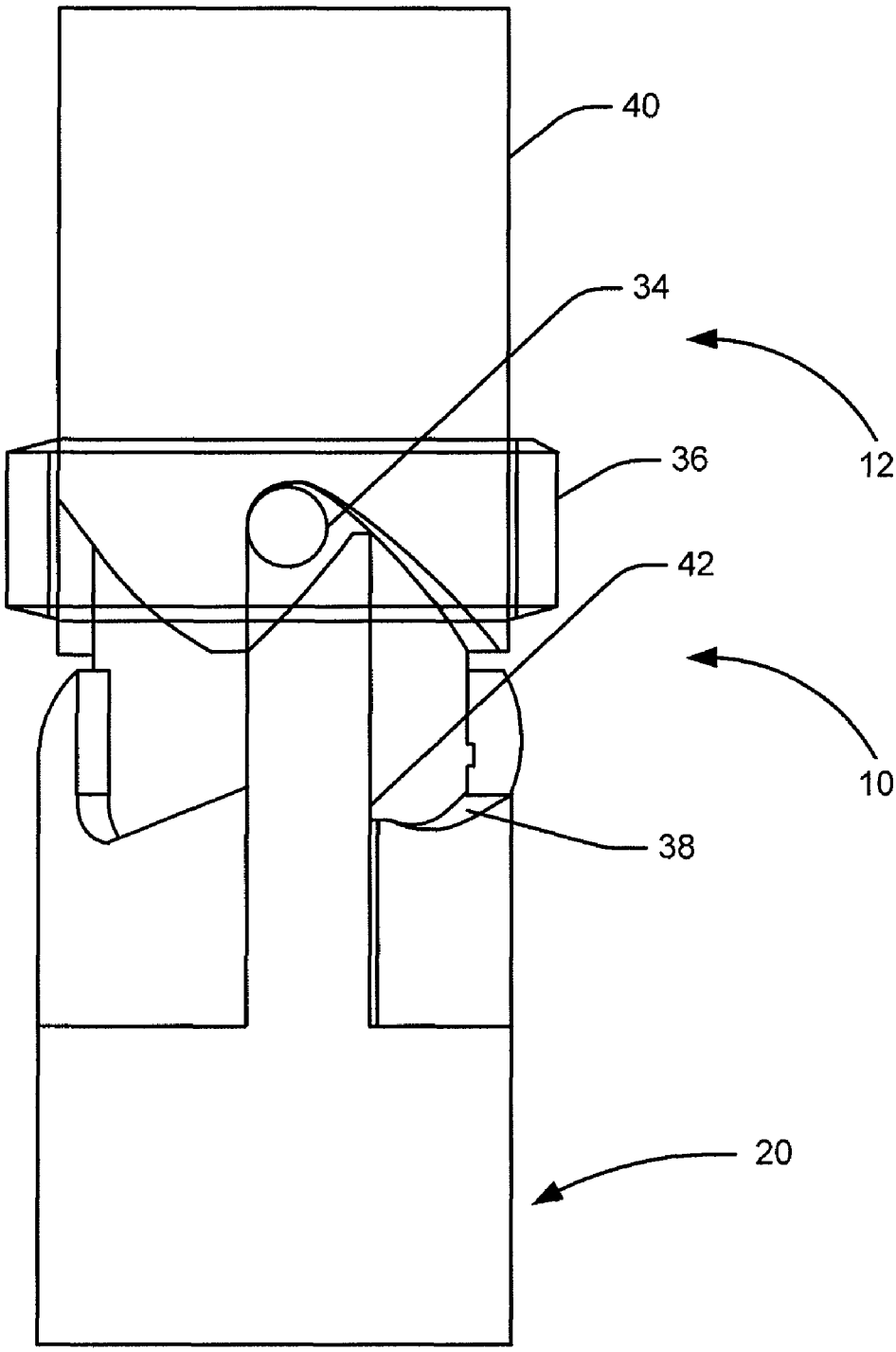
FIG. 3A is a side view showing one embodiment according to the present invention.
Figure 3B:
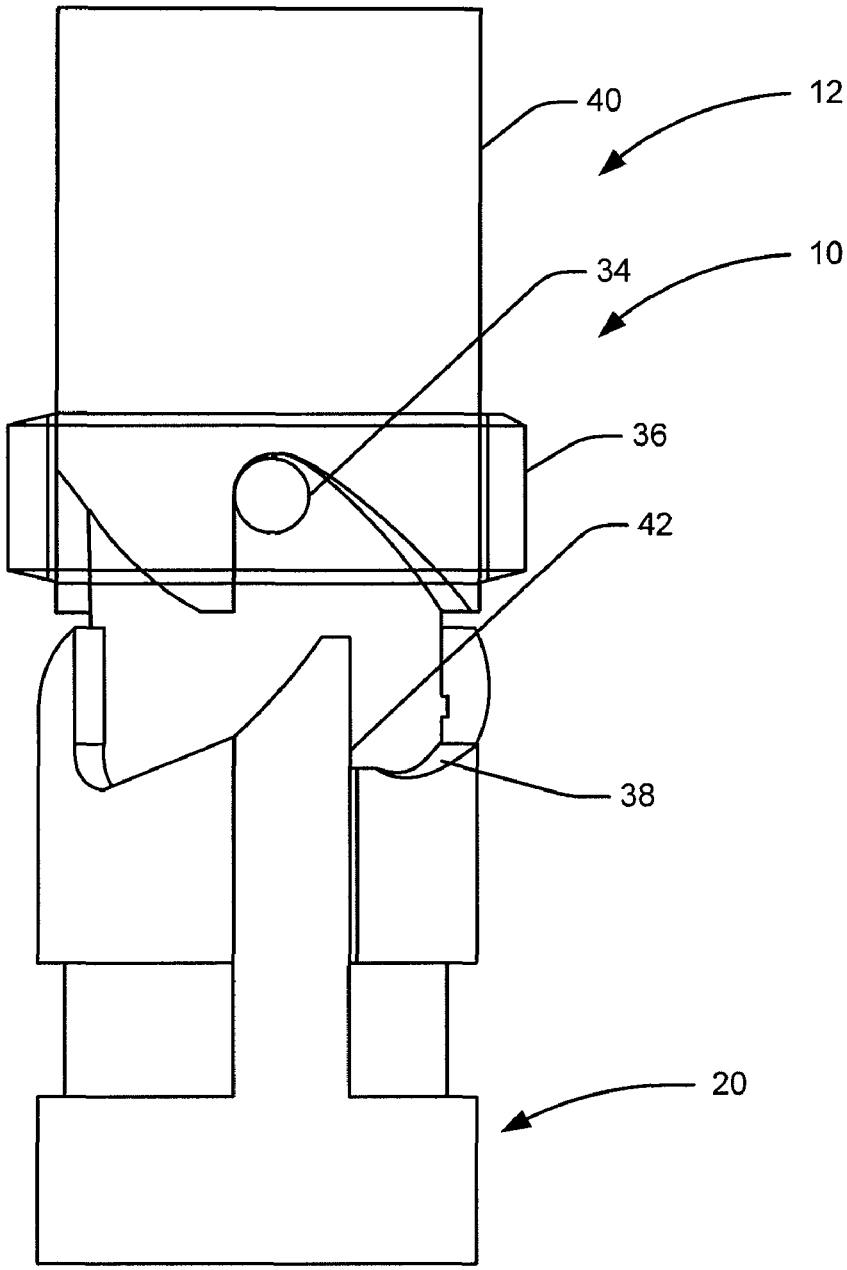
FIG. 3B is a side view of the embodiment illustrated in FIG. 3A, showing an unlocked position.

At least one fluid chamber 22 may be situated between actuating mandrel 14 and lock 20. Fluid chamber 22 may be sealed via one or more seals 24, along with a rupture disk 26 situated in the lock 20. Air at atmospheric pressure may initially fill the fluid chamber 22. As the tool 12 is lowered into the well bore, hydrostatic pressure outside the tool 12 increases. Once the hydrostatic pressure reaches a predetermined value, the rupture disk 26 may rupture. After the rupture disk 26 has ruptured, the fluid outside the tool 12 will enter the tool 12 through a port 28 formed therein. The resulting increased pressure within the fluid chamber 22 will cause the fluid chamber 22 to expand (as shown in FIG. 1B). This expansion causes the longitudinal movement of the lock 20 with respect to the actuating mandrel 14, thus "unlocking" the locking slot assembly 10. FIGS. 3A and 3B, which will be discussed below, further show the locked position and unlocked position respectively.

Figure 2A:
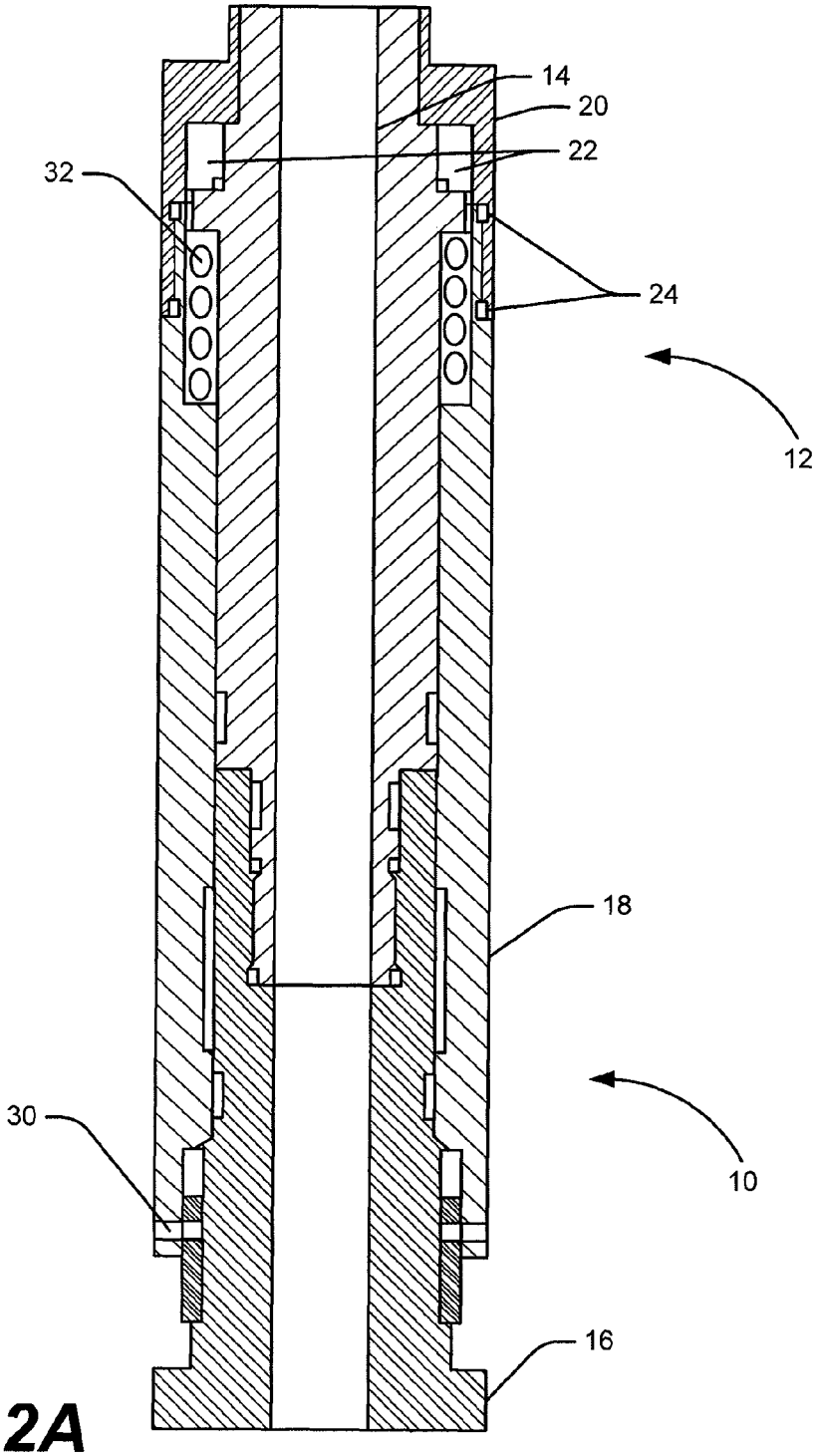
FIG. 2A is a side cross-sectional view showing another embodiment according to the present invention.
Figure 2B:
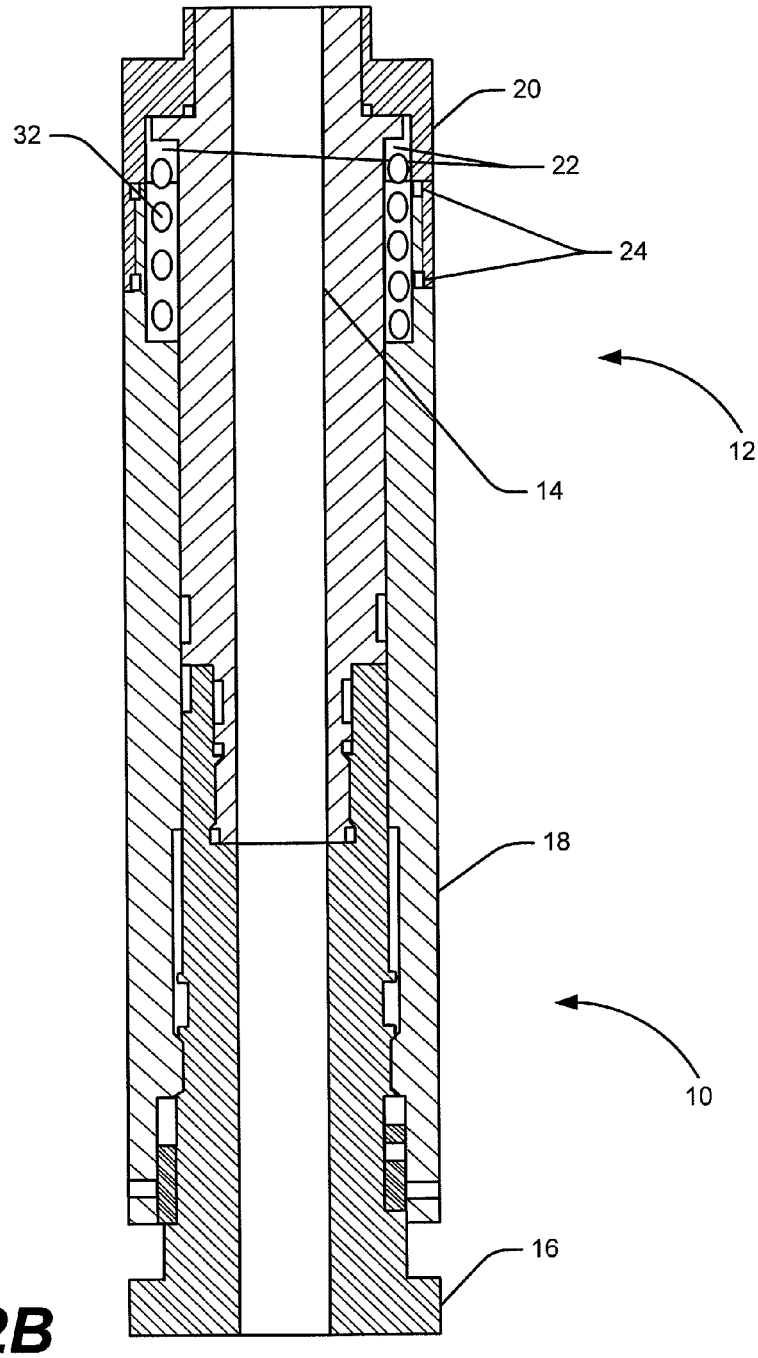
FIG. 2B is a side cross-sectional view of the embodiment illustrated in FIG. 2A, showing an unlocked position.

Referring now to FIGS. 2A and 2B, shown therein is an alternate embodiment of the locking slot assembly 10. This embodiment has no rupture disk 26. Instead, one or more shear pins 30 to prevent the lock 20 from moving until adequate pressure is present. A spring 32 may be included to keep the locking slot assembly 10 in an unlocked position. While the spring 32 shown is a coil spring, the spring 32 may be any biasing member. Likewise, the shear pin 30 may be a screw, spring, or any other shearable member. Other than the use of a rupture disk 26 and/or a spring 32, the embodiment of FIGS. 2A and 2B functions similarly to the embodiment of FIGS. 1A and 1B. An increase in pressure causes the lock 20 to move longitudinally with respect to the actuating mandrel 14, resulting in the unlocking of the locking slot assembly 10 (as shown in FIG. 2B).

Referring now to FIGS. 3A and 3B, one or more lugs 34 may extend from a lug rotator ring 36 into a continuous slot 38 in a sleeve 40, thus providing locking assembly 10. As previously discussed, pressure may cause the lock 20 to become unlocked. In the locked position, a locking portion 42 of the lock 20 occupies space within the slot 38, keeping the lugs 34 in a run-in-hole position, and preventing the lugs 34 from moving relative to the slot 38. As the lock 20 moves downwardly because of increased pressure, the locking portion 42 moves out of the slot 38, allowing the lugs 34 to move relative to the slot 38 if there is an upward or downward force acting on the sleeve 40.

In the run-in-hole, locked position, the lock 20 is in an upward position, in which lugs 34 are engaged with locking portion 42 of the lock 20. As the tool string is lowered into well bore, the locking slot assembly 10 will remain in the locked position shown in FIGS. 1A, 2A, and 3A, with the lock 20 preventing relative longitudinal movement of the lug rotator ring 36 with respect to the sleeve 40.

Once pressure is applied and the locking slot assembly 10 is unlocked (as shown in FIGS. 1B, 2B, and 3B), the locking slot assembly 10 may be actuated, allowing the lug rotator ring 36 to move longitudinally with respect to the sleeve 40. In other words, the tool 12 may be set by pushing downward on the tool string, which lowers lug 34. While any type of slot 38 may be used, the embodiment shown uses a j-slot, and in particular, shows a continuous J-slot. Depending on the specific application and the type of slot, setting the tool may involve pushing downward on the tool string multiple times. Thus, when a continuous j-slot is used, the tool 12 may be set by up and down motion alone. This may prevent the operator from cycling through the slot and setting the tool 12 prematurely.

For retrieval, the tool string is simply pulled upwardly out of the well bore. This will cause the lug 34 to re-engage the slot 38. Additionally, as the pressure outside the tool 12, and thus, the pressure within the fluid chamber 22 is reduced, the lock 20 may move back into the locked position, preventing any subsequent relative movement of the lug rotator ring 36 with respect to the sleeve 40.

While the application of pressure is disclosed above as one triggering event to allow the lug 34 to move within the slot 38, other events may also occur to allow the lug 34 to move within the slot 38. In this case, the lock 20 may be configured to allow the lug 34 to move within the slot after the triggering event has occurred, so long as a predetermined condition is maintained. For example, but not by way of limitation, the triggering event may be a timer reaching a predetermined value, and the predetermined condition may be that the timer has not yet reached a second predetermined value.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method of activating a downhole tool assembly comprising a sleeve having a continuous j-slot, a lug rotator ring configured to move axially relative to the sleeve and having a lug configured to move within the continuous j-slot, and lock comprising a rupture disk configured to prevent the lug from moving within the continuous j-slot during run-in, the method comprising:

lowering the downhole tool assembly into a well bore on a tool string;

rupturing the rupture disk, allowing the lug to move within the continuous j-slot; and setting the downhole tool assembly by lifting upward and pushing downward on the tool string.

2. The method of activating a downhole tool assembly of claim 1, wherein setting the downhole tool assembly tool comprises lifting upward or pushing downward on the tool string multiple times.

3. The method of activating a downhole tool assembly of claim 1, wherein rupturing the rupture disk comprises applying pressure.

4. The method of activating a downhole tool assembly of claim 3, wherein the pressure comprises hydrostatic pressure.

5. The method of activating a downhole tool assembly of claim 1, further comprising unsetting the downhole tool assembly by lifting upward and pushing downward on the tool string.

6. The method of activating a downhole tool assembly of claim 5, further comprising retrieving the downhole assembly by pulling upwardly on the tool string.

7. The method of activating a downhole tool assembly of claim 1, wherein the downhole tool assembly comprises a packer.

8. The method of activating a downhole tool assembly of claim 1, wherein the downhole tool assembly comprises a valve.

* * * * *